US008607718B2

(12) United States Patent
Wessel

(10) Patent No.: US 8,607,718 B2
(45) Date of Patent: Dec. 17, 2013

(54) RECOVERY BOILER COMBUSTION AIR SYSTEM WITH INTERMEDIATE AIR PORTS VERTICALLY ALIGNED WITH MULTIPLE LEVELS OF TERTIARY AIR PORTS

(75) Inventor: Richard A. Wessel, Massillon, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 507 days.

(21) Appl. No.: 11/694,125

(22) Filed: Mar. 30, 2007

(65) Prior Publication Data

US 2008/0236459 A1 Oct. 2, 2008

Related U.S. Application Data

(60) Provisional application No. 60/908,560, filed on Mar. 28, 2007.

(51) Int. Cl.
*D21C 11/14* (2006.01)
*F23G 7/04* (2006.01)
*F23L 9/02* (2006.01)

(52) U.S. Cl.
USPC ..... 110/238; 110/260; 110/297; 162/31

(58) Field of Classification Search
USPC ..... 110/238, 346, 348; 162/31
See application file for complete search history.

(56) References Cited

U.S. PATENT DOCUMENTS 5,121,700 A 6/1992 Blackwell et al.
5,305,698 A 4/1994 Blackwell et al.
5,715,763 A * 2/1998 Fornetti et al. ..... 110/238
6,006,683 A * 12/1999 Janka et al. ..... 110/348
6,302,039 B1 10/2001 MacCallum et al.
6,408,771 B1 * 6/2002 Philippe et al. ..... 110/348
6,742,463 B2 * 6/2004 Saviharju et al. ..... 110/238
7,069,866 B2 * 7/2006 Uppstu ..... 110/238
7,185,594 B2 * 3/2007 Higgins et al. ..... 110/238
7,207,280 B2 * 4/2007 Saviharju et al. ..... 110/238

FOREIGN PATENT DOCUMENTS

CA 1308964 A1 10/1992

* cited by examiner

*Primary Examiner* — Kenneth Rinehart
*Assistant Examiner* — David J Laux
(74) *Attorney, Agent, or Firm* — Eric Marich

(57) ABSTRACT

A combustion air system particularly useful for Kraft process recovery boilers or soda process recovery boilers has a level of liquor air ports located above the black liquor guns, and multiple levels of tertiary air formed by substantially vertically aligned tertiary air ports located above the black liquor guns. The liquor air ports and the tertiary air ports are on the same opposing walls of the furnace and are substantially vertically aligned with air ports in the same wall at different levels. The liquor air ports are located just above the black liquor guns, within a range of about ½ foot to about four feet. The tertiary air ports are laterally offset with respect to the tertiary air ports on the opposing wall of the furnace. The first tertiary air level is located a vertical distance in the range of about four feet to twelve feet above the elevation of liquor air ports, and the second and any additional tertiary air levels are located and spaced from an adjacent tertiary air level at regular spaced vertical intervals in the range of about four feet to eight feet. The vertically aligned and laterally offset tertiary air ports form a combustion air pattern of vertical sheets which travel across the width of the furnace to the opposing wall to carry smaller liquor particles to the walls of the furnace and reduce carryover and improve combustion efficiency.

39 Claims, 7 Drawing Sheets

RECOVERY BOILER COMBUSTION AIR SYSTEM WITH INTERMEDIATE AIR PORTS VERTICALLY ALIGNED WITH MULTIPLE LEVELS OF TERTIARY AIR PORTS

RELATED APPLICATION DATA

This application claims the benefit of U.S. Provisional Application No. 60/908,560 filed Mar. 28, 2007 and titled "RECOVERY BOILER COMBUSTION AIR SYSTEM WITH INTERMEDIATE AIR PORTS VERTICALLY ALIGNED WITH MULTIPLE LEVELS OF TERTIARY AIR PORTS". The complete text of U.S. Provisional Application No. 60/908,560 filed Mar. 28, 2007 is hereby incorporated by reference in its entirety as though fully set forth herein.

FIELD OF THE INVENTION

The present invention is in the general field of power generation and industrial boiler design and, more specifically, combustion air systems for industrial boilers, especially Kraft process recovery boilers or soda process recovery boilers used in the pulp and paper industry.

BACKGROUND OF THE INVENTION

Industry demand for higher black liquor processing capacity in Kraft recovery boilers has caused a significant increase in furnace shaft velocity and particle carryover. Demand for higher energy efficiency in recovery boilers has also increased black liquor solids content delivered to the boiler, causing smaller mass-median droplet size from black liquor spray nozzles and a further increase in carryover. Higher carryover results in an increase in fouling and plugging of convection pass surfaces.

For a general discussion of chemical and heat recovery in the pulp and paper industry, and the particular aspects of the alkaline pulping and chemical recovery process, reference is made to *Steam/its Generation and Use*, 41$^{st}$ Ed., Kitto and Stultz, Eds., Copyright© 2005, The Babcock & Wilcox Company, Chapter 28, the text of which is hereby incorporated by reference as though fully set forth herein. FIG. 1 is sectional side view of a known design of a Kraft recovery boiler manufactured by The Babcock & Wilcox Company, generally designated 1. The two main functions of a Kraft process recovery boiler, soda process recovery boiler, or simply, "recovery boiler", are to burn the organic portion of black liquor (a by-product of chemical pulping) to release energy for generating steam and to reduce the oxidized inorganic portion of black liquor in a pile, or bed, supported by the furnace floor. The molten inorganic chemicals in the bed, known as smelt, are discharged to a tank of water where they are dissolved and recovered as green liquor.

The recovery boiler 1 illustrated in FIG. 1 comprises a furnace 10 which is typically rectangular in cross-section, having enclosure walls 12 formed of water or steam-cooled tubes. The black liquor is fed into a lower portion of the furnace 10 through one or more black liquor BL spray nozzles 14 (also referred to as "black liquor guns", "liquor guns", or simply BL nozzles 14) which spray the black liquor into the furnace 10 through openings in the enclosure walls 12. The furnace 10 is generally rectangular in cross-section, and has a front wall 16, a rear wall 18 and two side walls 20. The front of the recovery boiler 1 is defined as the left hand side of FIG. 1, the rear of the recovery boiler 1 is defined as the right hand side of FIG. 1, and the width of the recovery boiler 1 is perpendicular to the plane of the paper on which FIG. 1 is drawn. The left hand side wall LHSW of the boiler 1 is defined as that side wall 20 on the left as one faces the front of the recovery boiler 1, and the right hand side wall RHSW is defined as that side wall 20 on the right.

With a conventional air system, combustion air is introduced into the recovery boiler 1 furnace 10 via air ports at staged elevations above a floor 22 of the furnace 10. These elevations are—primary air 24, secondary air 26, and tertiary air 28, as shown in FIG. 1. Typically, one fourth to one half of the air enters at the primary air PA level 24 near the furnace floor 22. The balance of the air for combustion is staged at the secondary air SA 26 and tertiary air TA 28 levels. The last stage or elevation of air, the tertiary air TA 28, is typically introduced at an elevation seven to fourteen feet above the black liquor nozzles 14. Good penetration and mixing of the tertiary air TA is needed to complete combustion of the black liquor and combustible gases (CO, $H_2$, and $H_2S$) within the furnace 10. The gases generated by combustion rise out of the furnace 10 and flow across convection heat transfer surfaces. Superheater surface 30 is arranged at the entrance to the convection pass, followed by steam generating (boiler bank) surface 32 and finally economizer surface 34. The water-cooled furnace enclosure walls 12 and the volume of the furnace 10 provide the necessary surface and retention time to cool the gas to temperatures where sootblowers can effectively remove the chemical ash from the convection surfaces. A furnace arch or nose 36 shields the superheater surface 30 from the radiant heat of the furnace 10 and uniformly distributes the gas flow entering the superheater surface 30.

The BL nozzles 14 produce a spray with a distribution in droplet size and a mass median droplet size of about 2-4 mm. Large particles (e.g. >3 mm) from the BL nozzles have downward trajectories because they are mostly influenced by their initial momentum and by gravity. The smallest particles of black liquor (<1 mm) are mostly influenced by aerodynamic drag forces and are lifted upward with the gas flow. These particles are known as carryover. Carryover particles are deposited on convection pass surfaces, which cause fouling and plugging of those surfaces and is detrimental to boiler heat transfer performance and continuous operation of the boiler. An air system design influences the quantity of particle carryover in two ways: 1) the magnitude and distribution of vertical velocity that provides lift for small particles, and 2) horizontal gas currents that push small particles towards the furnace walls, where they are deposited and removed from the gas.

Conventional air systems with the described three levels of combustion air typically have just one level of tertiary air above the black liquor nozzles 14, the principal function of which is to provide air to complete combustion of combustible gases and particles which ascend in the furnace. Formetti et al., U.S. Pat. No. 5,715,763 discloses a black liquor recovery boiler furnace having quaternary air injection ports located in the furnace walls in the vicinity of, or at approximately the same elevation as, the black liquor injection guns. Blackwell et al., U.S. Pat. No. 5,121,700, discloses a method of introducing air into a recovery boiler furnace which introduces air via sets of small and large jets on opposite walls, the small jets opposing large jets, and which is referred to in the patent as partial interlacing. The concept of vertically aligned air ports was originated by E. Uppstu et al. 1995, and is exclusively applied to secondary air systems in United States Patent Application Publication US 2004/0149185, and U.S. Pat. No. 6,742,463.

SUMMARY OF THE INVENTION

The aforementioned systems do not include aspects of the present invention which include a combination of intermediate air ports located just above the black liquor guns, and multiple levels of tertiary air formed by vertically aligned tertiary air ports in opposing walls of the boiler furnace as described herein.

Generally, the recovery boiler air system according to the present invention features: one-level of secondary air (SA) ports on the front and rear walls of the recovery boiler furnace, arranged with fully-interlaced ports and a larger number of SA ports on the rear wall than on the front wall. An intermediate, liquor air (LA) level is provided just above the black liquor (BL) guns, on the front and rear walls. The arrangement of the LA ports is aligned with tertiary air (TA) ports which are provided on the front and rear walls above the LA ports. At least two levels of TA ports are provided on both the front and rear walls, with close vertical spacing (or coupling), in a fully interlaced arrangement of TA ports that are substantially vertically aligned, and a larger number of TA ports is provided on the front wall than on the rear wall (i.e., opposite the SA ports arrangement).

Accordingly, one aspect of the present invention is drawn to an air port arrangement associated with the combustion air system for a recovery boiler having a furnace with a front wall, a rear wall opposing the front wall, and two side walls adjoining the front and rear opposing walls, a plurality of black liquor guns for injecting black liquor into the furnace, the black liquor guns being located in the walls of the furnace and at a common elevation with respect to a floor of the furnace, and a combustion air system for providing a supply of air to the furnace. The air port arrangement comprises several interrelated components, including: a plurality of primary air ports in walls of the furnace which form a primary air level. A plurality of secondary air ports is provided only in the front and rear walls of the furnace which form one secondary air level at an elevation above the primary air level and below the common elevation of the plurality of black liquor guns, the number of secondary air ports on one wall being one greater than the number of secondary air ports on the opposing wall, the secondary air ports on one wall being laterally offset from the secondary air ports on the opposing wall. An elevation of liquor air ports is provided only in the front and rear walls of the furnace, together with a plurality of tertiary air ports only in the front and rear walls of the furnace which form at least two or more tertiary air levels above the elevation of liquor air ports, wherein the tertiary air ports and the liquor air ports are substantially vertically aligned with one another.

Another aspect of the present invention is drawn to a combustion air system for a recovery boiler having four generally orthogonal walls and a floor. The combustion system includes a primary air level formed by a plurality of primary air ports in all of the walls of the furnace proximate to the floor. A single secondary air level is formed by opposed secondary air ports in front and rear walls of the furnace above the primary air ports. Black liquor guns in the walls of the furnace are provided above the single secondary air level of opposed secondary air ports, and an elevation of liquor air ports only in the front and rear walls of the furnace are located a vertical distance in the range of about zero to four feet above the elevation of black liquor guns. Finally, at least first, second and third tertiary air levels formed by tertiary air ports are provided only in the front and rear walls of the furnace above the black liquor guns, the tertiary air ports arranged in substantially vertically aligned columns in opposing walls of the furnace and aligned with the liquor air ports. Each tertiary air port is located at one of the at least three tertiary air levels, the first tertiary air level located a vertical distance in the range of about four feet to twelve feet above the elevation of liquor air ports, and the second and any additional tertiary air levels are located and spaced from an adjacent tertiary air level at regular spaced vertical intervals in the range of about four feet to eight feet.

Yet still another aspect of the present invention involves the application of the combustion air system to industrial boilers which do not burn black liquor, and instead burn a solid fuel such as wood or biomass. In such types of industrial boilers which burn these alternative types of fuels, the black liquor guns would be replaced by fuel injection devices such as known mechanical distribution devices for solid fuels; e.g. fuel spreaders, fuel chutes, or the like. The liquor air ports in such applications would be referred to as fuel air ports or the like.

Yet another aspect of the present invention is drawn to a method for reducing particle carryover, while achieving rapid mixing and burnout of combustible gases, and minimum corrosion is disclosed. One benefit is the reduction of $NO_x$ emissions through deeper staging of combustion air.

The various features of novelty which characterize the invention are pointed out with particularity in the claims annexed to and forming a part of this disclosure. For a better understanding of the invention, its operating advantages and the specific benefits attained by its uses, reference is made to the accompanying drawings and descriptive matter in which preferred embodiments of the invention are illustrated.

DESCRIPTION OF THE PREFERRED EMBODIMENTS

Figure 1:
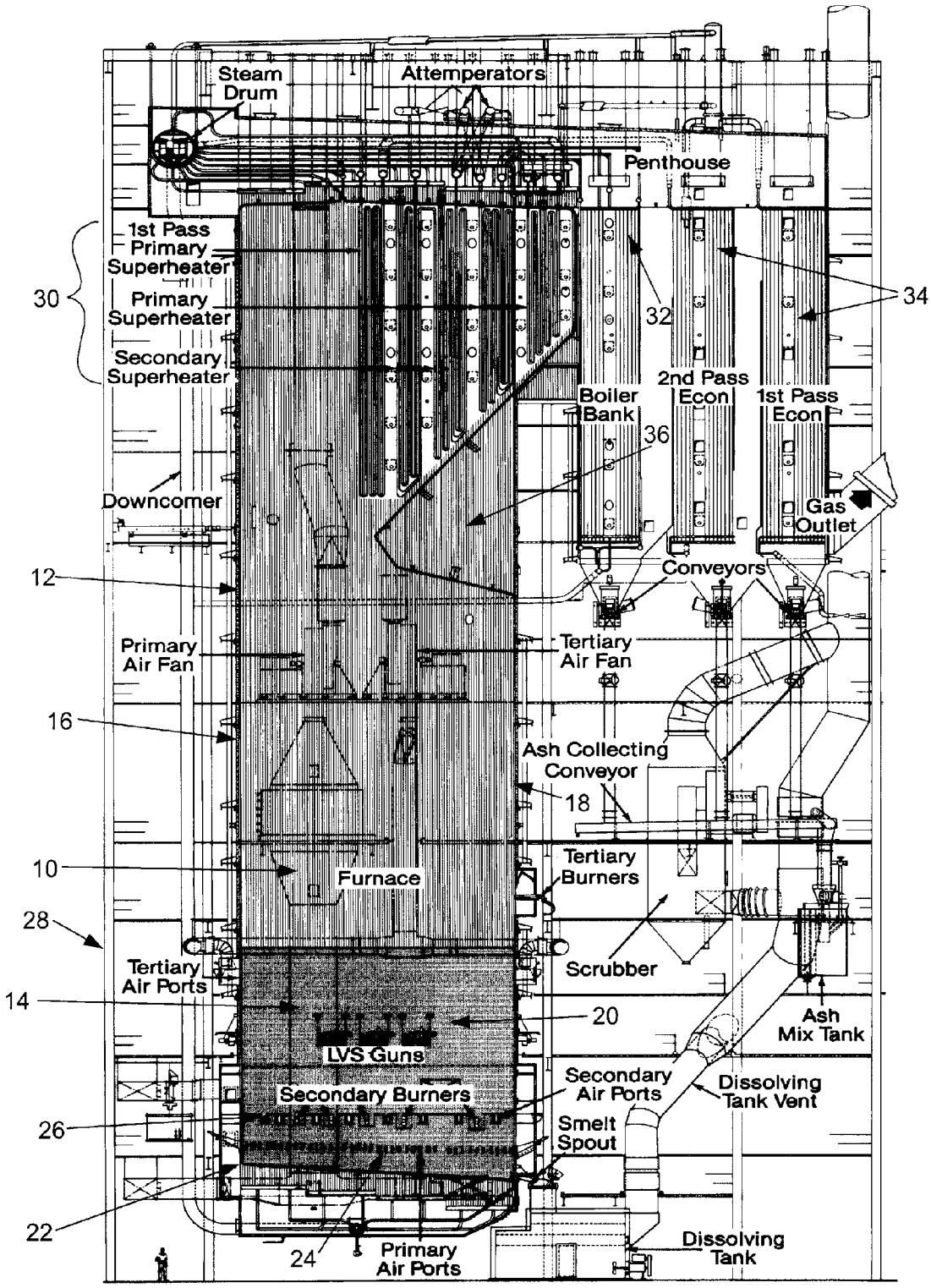
FIG. 1 PRIOR ART
FIG. 1 is sectional side view of an elevation of a known Kraft recovery type boiler manufactured by The Babcock & Wilcox Company.
Figure 2:
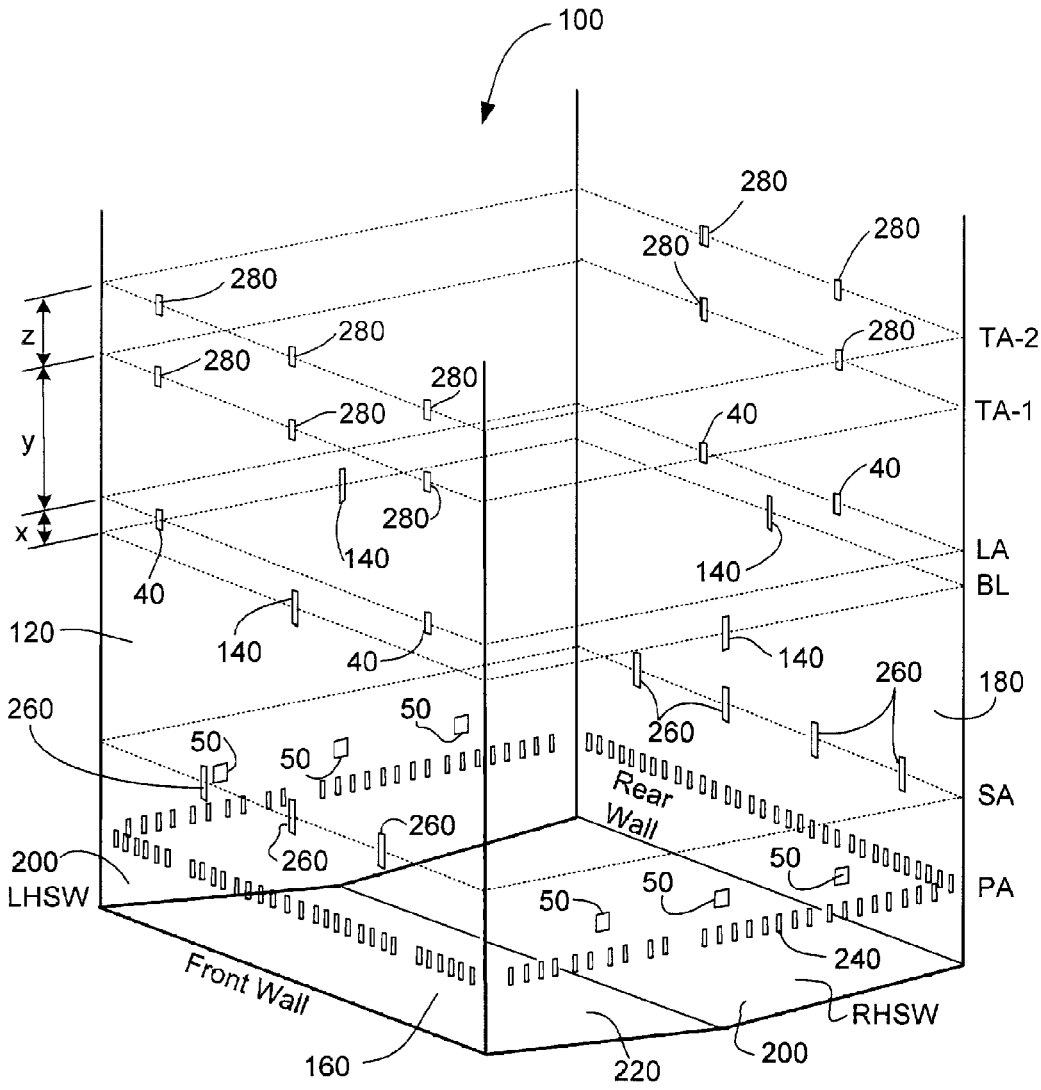
FIG. 2 is a schematic perspective view of a recovery boiler with a first embodiment of a combustion air system according to the present invention, wherein a level of liquor air LA is provided near the black liquor guns elevation along with multiple levels of vertically aligned tertiary air ports.

Referring to the drawings generally, wherein like reference numerals designate the same or functionally similar elements throughout the several drawings, and to FIG. 2 in particular, there is shown a furnace 100 of a recovery boiler having a first embodiment of a combustion air system constructed in accordance with the principles of the present invention. Certain similarities between this embodiment of FIG. 2, and those illustrated and described in later Figures, will become apparent.

While the following description is provided in the context of a recovery boiler of the Kraft recovery boiler type, it will be appreciated that the present invention is also applicable to soda process recovery boilers, and to industrial boilers as described herein. Accordingly, while the following description thus uses the term black liquor guns to refer primarily to the firing of black liquor in Kraft recovery boilers, the fuel used in the aforementioned soda processes is also fired via liquor guns and, in visual appearance, is also nearly indistinguishable from black liquor. Hereinafter, and in the claims annexed to and forming a part of this disclosure, the term black liquor guns or liquor guns is used interchangeably to refer to the appropriate fuel firing devices used for the fuel in question. Finally, while the computational fluid dynamic (CFD) models used during the development of the present invention were based upon the firing of black liquor in a Kraft recovery boiler, it is believed that similar results would be obtained with the soda process recovery boilers, or to the industrial boilers described herein, and thus the present invention includes all these Kraft recovery, soda process recovery and industrial boilers.

The furnace 100 comprises furnace enclosure walls 120, front wall 160, rear wall 180, two side walls 200 more particularly designated as left and right hand side walls LHSW and RHSW, respectively, a floor 220, an arrangement of black liquor (BL) nozzles 140 at an elevation BL, and auxiliary burners 50. A primary air level PA is formed by primary air ports 240, a secondary air level SA formed by secondary air ports 260, a liquor air level LA formed by liquor air ports 40, and multiple tertiary air (TA) levels TA-1-TA-M, where M=2 or 3, formed by tertiary air ports 280. The liquor air level LA is the first level of combustion air introduced into the furnace 100 at an elevation above the black liquor nozzles elevation BL having the BL nozzles 140.

The secondary air ports 260 are all preferably the same size, and arranged to form only one secondary air level SA at an elevation above the primary air level PA and below a common elevation of the plurality of black liquor guns at the liquor gun level BL. In addition, it is preferred that the number of secondary air ports 260 on one wall (front or rear) is one greater than the number of secondary air ports 260 on the opposing wall (front or rear), and the secondary air ports 260 on one wall are laterally offset from the secondary air ports 260 on the opposing wall, thereby forming a fully interlaced arrangement as is known to those skilled in the art. However, a fully interlaced arrangement is not absolutely essential. In other words, the secondary air ports 260 may comprise larger and smaller secondary air ports 260 which alternate across a width of the recovery boiler and wherein the larger secondary air ports on one wall oppose smaller secondary air ports on the other wall in a partially interlaced secondary air arrangement.

The liquor air is introduced only from opposing (e.g. front and rear) walls of the furnace through the liquor air ports 40, and the elevation of the liquor air level LA is a vertical distance x in the range of about ½ foot to four feet above the elevation BL of the black liquor nozzles 140. Tertiary air is also supplied from only the front and rear walls of the furnace at two or more horizontal levels, TA-1-TA-M. In the embodiment shown in FIG. 2, the liquor air level LA formed just above the level of the black liquor nozzles 140 is located preferably no higher than about four feet above the level of the black liquor nozzle elevation BL. The LA level can alternatively be considered and designated as one of the tertiary air levels, as further described, but differs from the tertiary air levels in that it is located close to the black liquor guns elevation BL. The first tertiary level TA-1 is provided at a vertical distance y in the range of about four feet to twelve feet above the liquor air level LA. Additional tertiary air levels such as TA-2 are located and spaced from an adjacent tertiary air level at regular spaced vertical intervals z (or t; see FIG. 6) in the range of about four feet to eight feet, depending upon the size of the furnace 100. The spacing would increase proportionally (linearly) with increases in a characteristic dimension of the furnace, such as the width or the depth. The embodiment of FIG. 2 is for a furnace with a width of approximately 32 feet, and a depth of approximately 36 feet. The principles of the present invention would be applicable to furnaces 100 with widths up to approximately 50 feet.

According to the present invention, the arrangement of tertiary air TA ports at any given level depends on the furnace width/depth ratio. For example, a substantially "square" furnace would typically be provided with an arrangement of 3 front wall and 2 rear wall TA ports—a "3F/2R" arrangement. In a furnace 100 which is narrower, it may be that a 2F/1R TA ports arrangement is required. Generally, the spacing between ports at a given level on either a front or a rear wall of the furnace 100 increases in proportion to the size of the furnace, taking various factors such as the degree of expansion of the air jets into account and how such air jets interact with jets from an opposing wall.

Figure 3A:
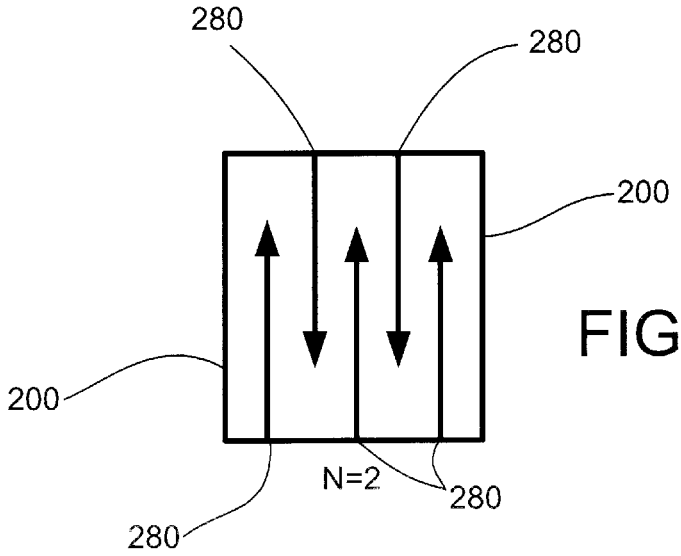
FIGS. 3A, 3B and 3C are schematic plan views of the locations of tertiary air ports according to the present invention for furnaces with different width to depth ratios.
Figure 3B:
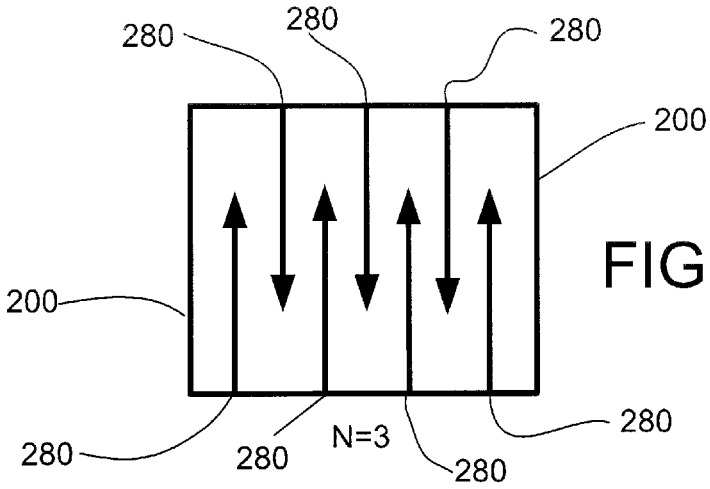
Figure 3C:
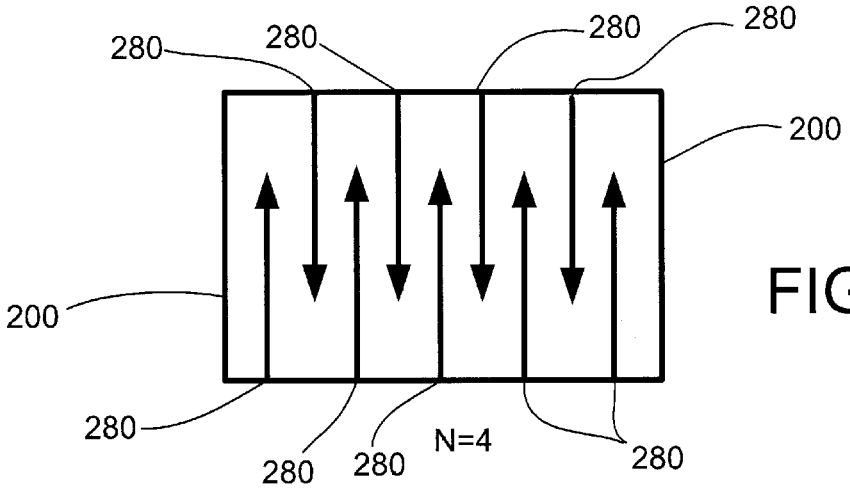

FIGS. 3A, 3B and 3C thus schematically illustrate various embodiments of air port arrangements of combustion air systems of the invention, as applied to recovery boilers having the generally rectangular configuration of four adjoining orthogonal walls which form the furnace of the boiler. In particular, FIGS. 3A, 3B and 3C illustrate representative lateral arrangements of the tertiary air ports 280 in opposed walls of the furnace 100 and may be applied to any of the arrangements of FIGS. 2, 5 and 6. The tertiary air ports 280 of one wall are interlaced with the tertiary air ports of an opposing wall due to the lateral offsets shown, with one extra tertiary air port 280 on one of the opposing walls. This arrangement enables the vertical sheets air flow to extend from the originating wall to the opposite wall of the furnace to accomplish the desired effect of pushing small particles to the walls of the furnace to reduce carryover. As shown, the number of TA ports 280 will increase as the width/depth ratio increases. FIG. 3A illustrates the arrangement of FIG. 2—a 3F/2R arrangement, while FIGS. 3B and 3C illustrate 4F/3R and 5F/4R arrangements, respectively.

Preferably, the combustion air system of the present invention also provides an air port arrangement wherein the number of tertiary air ports 280 at a given elevation on one wall is greater than the number of tertiary air ports 280 at the same elevation on the opposing wall, and arranged on opposing walls such that the tertiary air ports 280 on the opposing walls are laterally offset with respect to each other. Still further, it is also preferred to arrange the air ports so that the wall having the greater number of tertiary air ports 280 is opposite the wall having the greater number of secondary air ports 260. In these cases, the rear wall 180 may have the greater number of secondary air ports 260, or the front wall 160 may have the greater number of secondary air ports 260. However, combustion air systems according to the present invention may also be such that the same wall, either the front wall 160 or the rear wall 180, may be provided with the greater number of secondary air ports 260 and tertiary air ports 280.

As is known in the art, the furnace enclosure walls 120 are formed of water or steam-cooled tubes which form the boiler water circuit. Air ports are formed through the enclosure walls 120 of the furnace 100 at multiple locations at the various described levels, with air ducts (not shown) leading to the ports from an air supply (also not shown) to control furnace operation. Although shown in the context of this particular boiler design, the principles of the invention are not limited to these specific embodiments or application to only this type of boiler design. For example, the combustion air systems according to the present invention may also be applied to other types of industrial boilers which do not burn black liquor, and instead burn a solid fuel such as wood or biomass. It will be appreciated by those skilled in the art that in such types of industrial boilers which burn these alternative types of fuels, the black liquor guns would be replaced by fuel injection devices such as known mechanical distribution devices for solid fuels; e.g. fuel spreaders, fuel chutes, or the like. The liquor air ports 40 in such applications would be referred to as fuel air ports 40 or the like.

If auxiliary fuel burners 50 are provided, they are preferably provided on the side walls of the furnace 100, or on locations on the front and rear walls that do not interfere with air jet penetration from the SA ports.

Returning to FIG. 2, the combustion air system primary air level PA is defined by a plurality of primary air ports 240 located at a lower or lowest elevation of the furnace 100, closest to the floor 220 of the boiler. The secondary air level SA is defined by the secondary air ports 260 located at an elevation above the primary air level PA and below the elevation BL of the black liquor guns 140. The tertiary air ports 280 which define the tertiary air levels TA-1 and TA-2 are arranged laterally so as to form an interlaced airflow pattern with N jets from one wall and N+1 jets from the opposite wall, and as illustrated in FIGS. 3A through 3C, N is an integer from 2 to 4. The tertiary air ports 280 which form the tertiary air levels are substantially vertically aligned on the respective front and rear walls of the boiler, one above the other in vertical columns as shown. As further shown in FIG. 2, the LA ports 40 have the same horizontal arrangement as the tertiary air ports 280 (with the possible exception that one or more ports are not provided if they are in the vicinity of a black liquor nozzle 140), and the LA ports 40 are also aligned vertically with the tertiary air level ports 280. The LA ports 40 are preferably located approximately two feet above the elevation BL of the black liquor guns 140. The tertiary air level TA-1 is preferably located approximately ten feet above the elevation BL of the black liquor guns 140. The tertiary air level TA-2 is preferably located approximately fourteen feet above the elevation BL of the black liquor guns 140. With this particular embodiment, the combined air flow to the liquor air LA and tertiary-air TA levels is 25 to 40% of the total air flow, and initial jet velocity is about 130 to 260 ft/sec.

With liquor air injection through the LA ports 40, strong horizontal gas currents are created by the LA ports 40 just above elevation BL of the black liquor nozzles 140; small particles are entrained by the horizontal gas currents and pushed toward the walls of the furnace; and carryover removal is started at the lowest possible elevation in the furnace without interfering with the spray distribution of large droplets. Horizontal gas currents are reinforced at the tertiary air levels TA-1, TA-2, etc. which continue the process of carryover removal. The liquor spray distribution (of large droplets) to the furnace walls and char bed is not affected by the liquor air injection through the LA ports 40, particularly when splash-plate type black liquor nozzles 140 are used and tilted downward to direct the coarse spray down toward the furnace floor 220.

Figure 4:
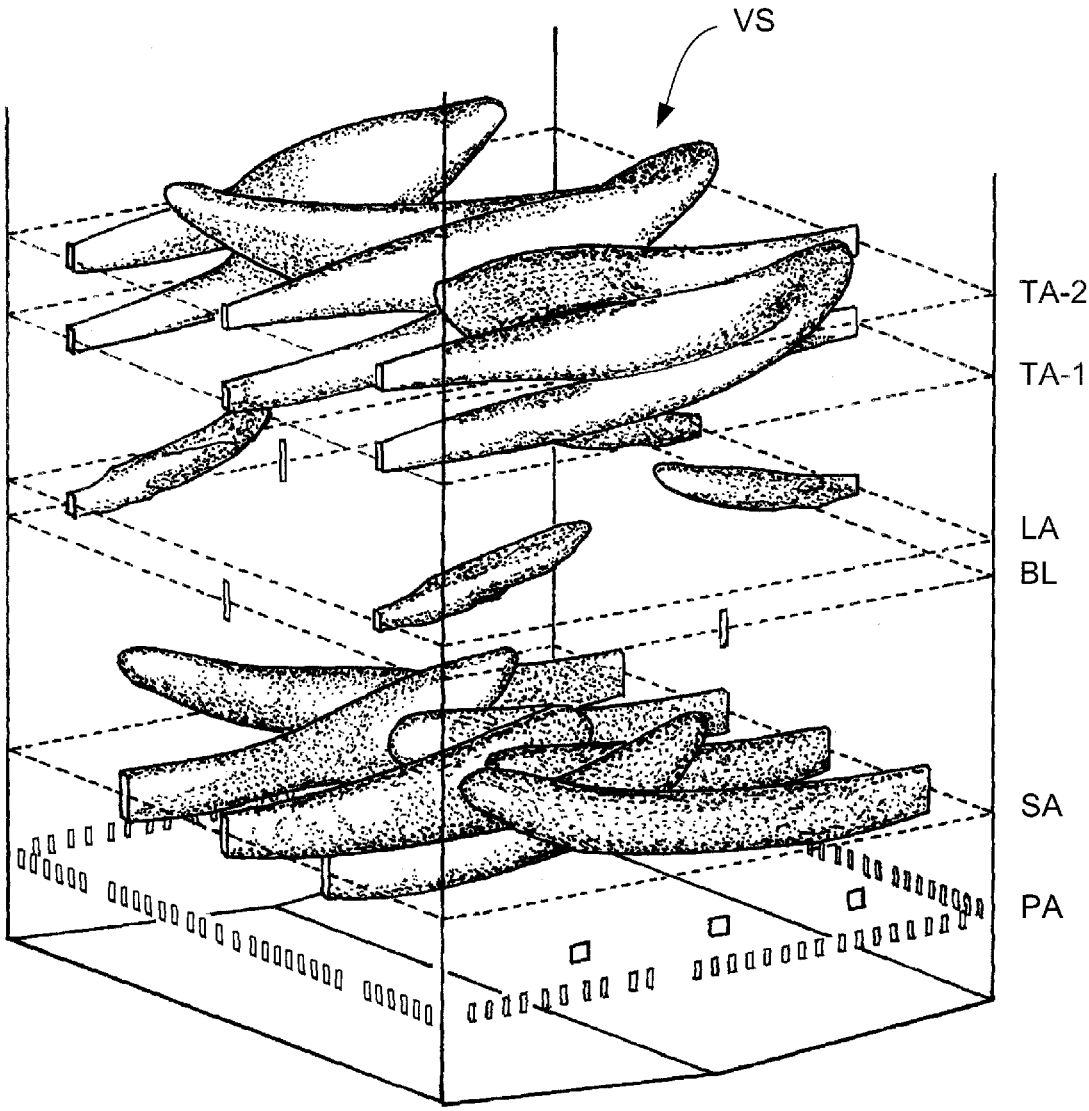
FIG. 4 is a schematic perspective view of the recovery boiler of FIG. 2 showing a resulting combustion air flow pattern.

As shown in FIG. 4, the vertically aligned tertiary air ports 280 reinforce jet penetration and create air flow patterns which appear as "vertical-sheets" VS of air that penetrate across the depth of the furnace. An expanded sheer layer between the vertical sheets enhances mixing and burnout of combustible gases (volatiles, CO and $H_2S$) in the upper furnace and potentially reduces chemical corrosion rates of furnace walls above the tertiary air levels. The vertical sheets VS are laterally offset and interlaced by the arrangement of the tertiary air ports 280 at each of the tertiary air levels TA-1, TA-2, as further described.

Figure 5:
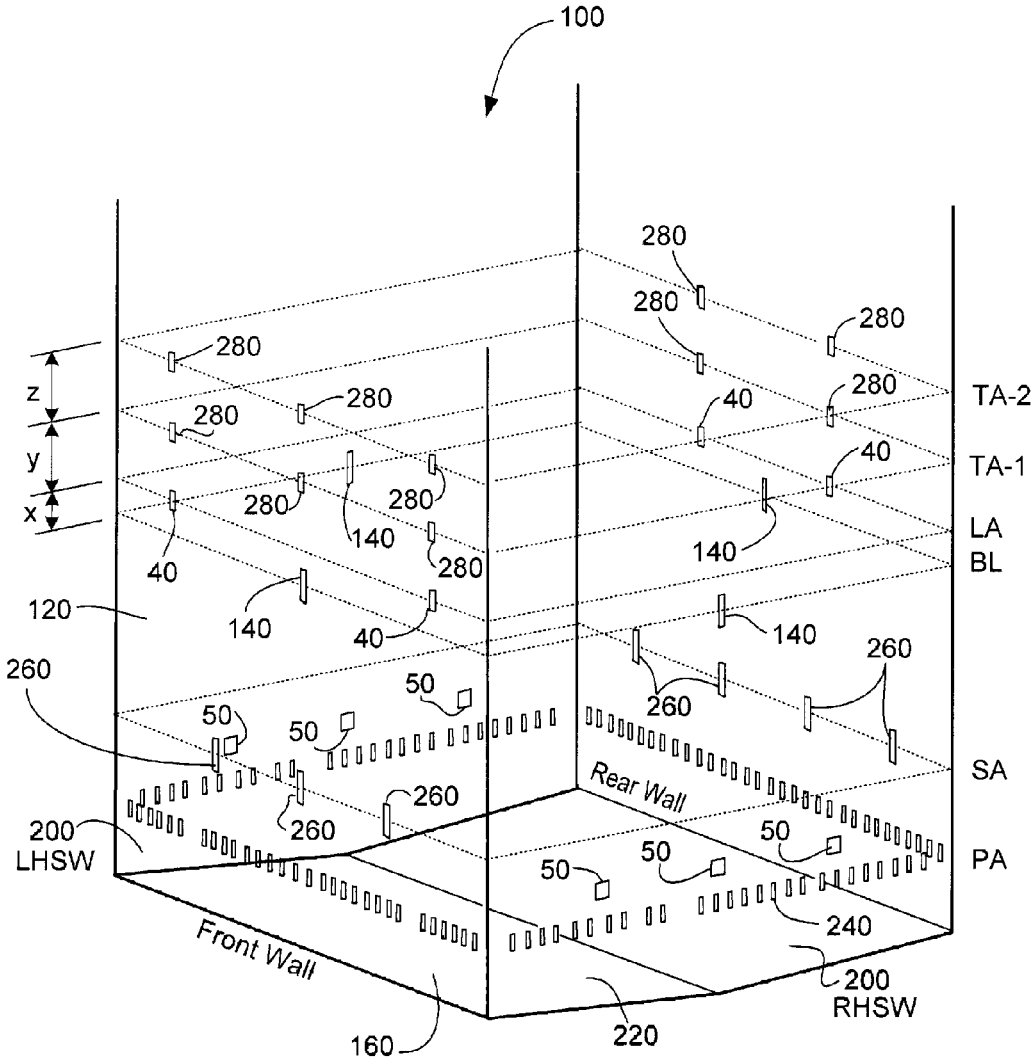
FIGS. 5 and 6 are schematic perspective views of a recovery boiler provided with second and third embodiments of the combustion air system according to the present invention, similar to that illustrated in FIG. 2.

FIG. 5 illustrates an alternate embodiment of a combustion air system for a recovery boiler according to the present invention, which includes two levels of tertiary air TA-1 and TA-2, formed by tertiary air ports 280 all of which are vertically aligned with the LA ports 40 in the liquor air level LA. In this embodiment, the LA ports 40 are located preferably approximately 2 feet above the elevation BL of the black liquor guns 140. The first tertiary air level TA-1, is located at an elevation preferably approximately 6 feet above the elevation BL of the black liquor guns 140. The other tertiary air level, TA-2, is located approximately ten feet above the elevation BL of the black liquor guns 140. As shown, all of the ports 280 of the tertiary air levels and the LA ports 40 of the liquor air level are vertically aligned in the respective walls of the furnace of the boiler.

Figure 6:
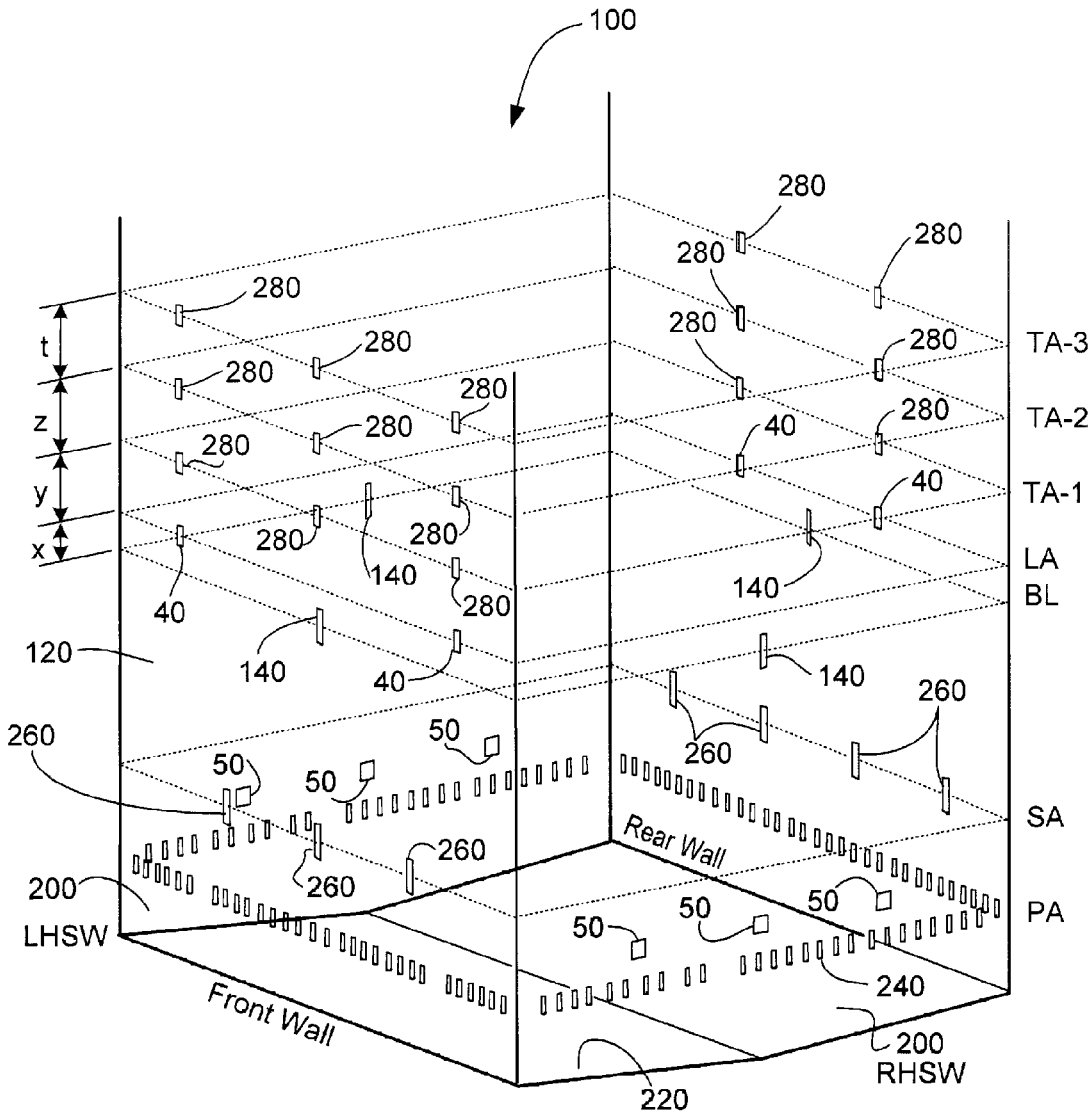

FIG. 6 illustrates an alternate embodiment of a combustion air system for a recovery boiler according to the present invention, which includes three levels of tertiary air TA-1, TA-2, and TA-3, formed by tertiary air ports 280 which are vertically aligned with the LA ports 40 in the liquor air level LA. In this embodiment, the LA ports 40 are again located preferably approximately 2 feet above the elevation BL of the black liquor guns 140. The first tertiary air level TA-1, is located preferably approximately 6 feet above the elevation BL of the black liquor guns 140; the second and third tertiary air levels TA-2, and TA-3 are regularly spaced and located approximately ten feet and fourteen feet, respectively, above the elevation BL of the black liquor guns 140. As shown, all of the tertiary air ports 280 of the tertiary air levels are vertically aligned with the LA ports 40 in the liquor air level LA in the respective walls of the furnace of the boiler. The third tertiary air level TA-3 is provided to increase the size and effect of the previously described vertical sheet VS air flow patterns and further reduce particle carryover.

Figure 7:
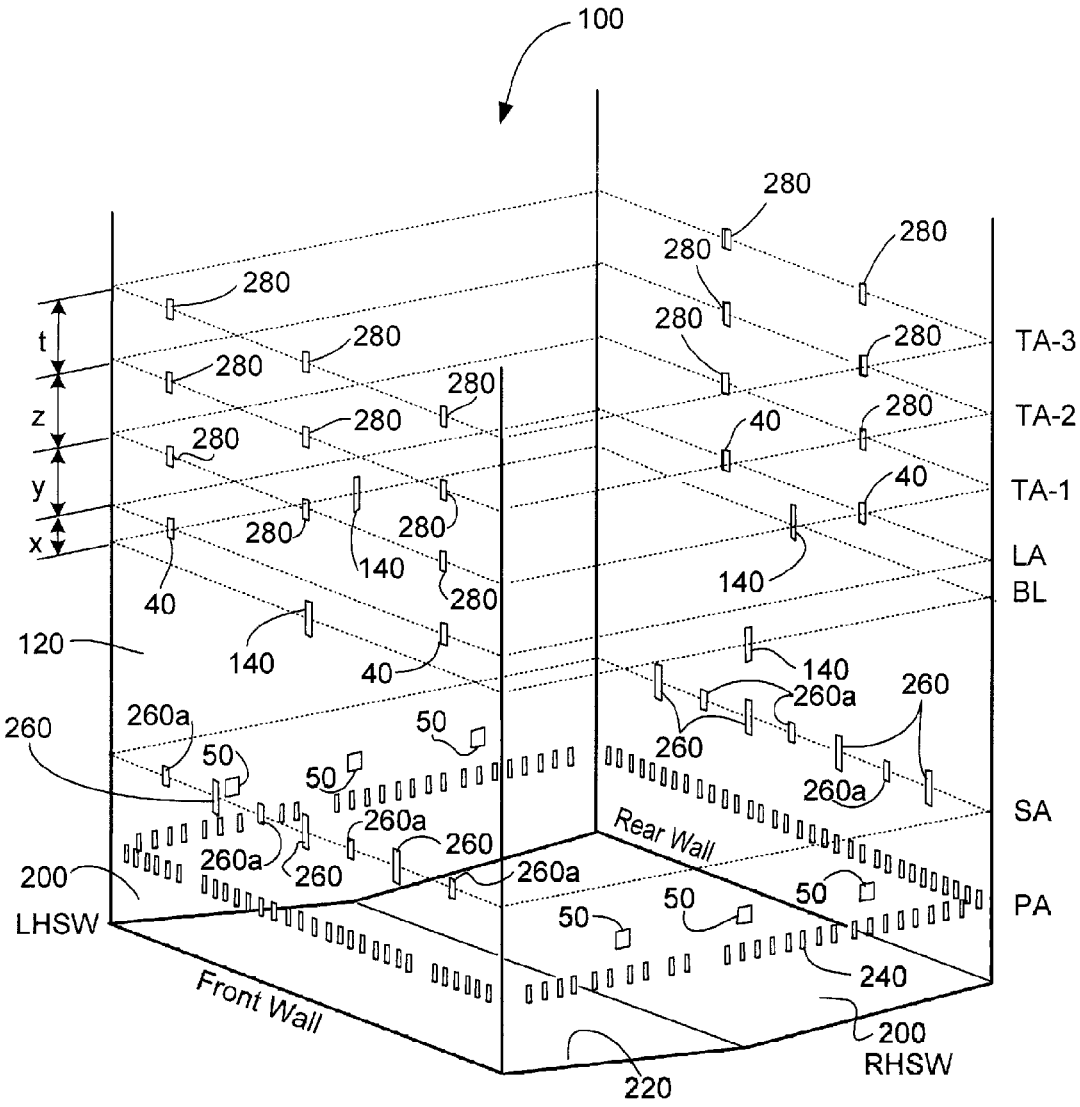
FIG. 7 is a schematic perspective view of a recovery boiler provided with a fourth embodiment of the combustion air system according to the present invention, similar to that illustrated in FIG. 2.

FIG. 7 is a schematic perspective view of a recovery boiler provided with a fourth embodiment of the combustion air system according to the present invention, similar to that illustrated in FIG. 2. The embodiment illustrated in FIG. 7 is similar to that of FIG. 6 except that the secondary air ports in two opposing walls of the furnace comprise larger secondary air ports 260 and smaller secondary air ports 260*a* that are arranged in an alternating fashion on each of the opposing walls of the furnace. As is illustrated in FIG. 7, the larger secondary air ports on one wall are directly opposite the smaller secondary air ports on the opposing wall.

Advantages of the recovery boiler air system according to the present invention include the ability to fire a wider range of black liquor solids, including and beyond 80% solids firing. Computational fluid dynamic (CFD) modeling of Kraft recovery boilers operating with the air system according to the present invention are predicted to have reduced emissions, the ability to maintain stable combustion in the lower furnace and char bed, and reduced carryover of particles resulting in improved ability to maintain clean convection heating surface for extended periods of operation.

While specific embodiments of the present invention have been shown and described in detail to illustrate the application and principles of the invention, it will be understood that it is not intended that the present invention be limited thereto and that the invention may be embodied otherwise without departing from such principles. For example, the present invention may be applied to new construction involving recovery boilers, or to the replacement, repair or modification of existing recovery boilers. In some embodiments of the invention, certain features of the invention may sometimes be used to advantage without a corresponding use of the other features. Accordingly, all such changes and embodiments properly fall within the scope of the following claims.

I claim:

1. A combustion air system for a recovery boiler having four generally orthogonal walls and a floor, comprising:

a primary air level formed by a plurality of primary air ports in all of the walls of the furnace proximate to the floor;

a single secondary air level formed by opposed secondary air ports in front and rear walls of the furnace above the primary air ports;

black liquor guns in the walls of the furnace above the single secondary air level of opposed secondary air ports;

an elevation of liquor air ports only in the front and rear walls of the furnace and located a vertical distance in the range of about zero to four feet above the elevation of black liquor guns; and at least first, second and third tertiary air levels formed by tertiary air ports only in the front and rear walls of the furnace above the black liquor guns, wherein the tertiary air ports in all of the at least first, second and third tertiary air levels are arranged in substantially vertically aligned columns in opposing walls of the furnace and wherein the columns are vertically aligned with the liquor air ports, each tertiary air port located at one of the at least three tertiary air levels, the first tertiary air level located a vertical distance in the range of about four feet to twelve feet above the elevation of liquor air ports, and the second and any additional tertiary air levels are located and spaced from an adjacent tertiary air level at regular spaced vertical intervals in the range of about four feet to eight feet, and wherein at least a portion of each of the at least three or more tertiary air levels in only one of the front wall, or the back wall, of the furnace are substantially vertically aligned with a black liquor gun.

2. The air port arrangement of claim 1, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is opposite the wall having the greater number of secondary air ports.

3. The air port arrangement of claim 2, wherein the rear wall has the greater number of secondary air ports.

4. The air port arrangement of claim 2, wherein the front wall has the greater number of secondary air ports.

5. The air port arrangement of claim 1, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is the same wall as the wall having the greater number of secondary air ports.

6. The air port arrangement of claim 1, wherein the rear wall has the greater number of secondary air ports.

7. The air port arrangement of claim 1, wherein the front wall has the greater number of secondary air ports.

8. The air port arrangement of claim 5, wherein the rear wall has the greater number of secondary air ports.

9. The air port arrangement of claim 5, wherein the front wall has the greater number of secondary air ports.

10. In a recovery boiler having a furnace with a front wall, a rear wall opposing the front wall, and two side walls adjoining the front and rear opposing walls, a plurality of black liquor guns for injecting black liquor into the furnace, the black liquor guns being located in the walls of the furnace and at a common elevation with respect to a floor of the furnace, and a combustion air system for providing a supply of air to the furnace, an air port arrangement associated with the combustion air system, the air port arrangement comprising:

a plurality of primary air ports in walls of the furnace which form a primary air level;

a plurality of secondary air ports only in the front and rear walls of the furnace which form one secondary air level at an elevation above the primary air level and below the common elevation of the plurality of black liquor guns, the number of secondary air ports on one wall being one greater than the number of secondary air ports on the opposing wall, the secondary air ports on one wall being laterally offset from the secondary air ports on the opposing wall;

an elevation of liquor air ports only in the front and rear walls of the furnace; and a plurality of tertiary air ports only in the front and rear walls of the furnace which form at least two or more tertiary air levels above the elevation of liquor air ports, wherein the tertiary air ports in all of the at least two or more tertiary air levels and the liquor air ports are substantially vertically aligned with one another and wherein at least a portion of each of the at least two or more tertiary air levels in only one of the front wall, or the back wall, of the furnace are substantially vertically aligned with a black liquor qun.

11. The air port arrangement of claim 10, wherein the elevation of the liquor air ports is located approximately two feet above the elevation of the black liquor guns.

12. The air port arrangement of claim 10, comprising two tertiary air levels located above the elevation of liquor air ports, a first tertiary air level located approximately ten feet above the elevation of the black liquor guns, and a second tertiary air level located approximately fourteen feet above the elevation of the black liquor guns.

13. The air port arrangement of claim 10, comprising three levels of tertiary air located above the elevation of liquor air ports and wherein each tertiary air port is vertically aligned with a tertiary air port in an adjacent tertiary air level and with the liquor air ports in the elevation of the liquor air ports.

14. The air port arrangement of claim 13, wherein a first tertiary air level is located approximately six feet above the elevation of the black liquor guns, a second tertiary air level is located approximately ten feet above the elevation of the black liquor guns, and a third tertiary air level is located approximately fourteen feet above the elevation of the black liquor guns.

15. The air port arrangement of claim 10, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is opposite the wall having the greater number of secondary air ports.

16. The air port arrangement of claim 10, wherein the rear wall has the greater number of secondary air ports.

17. The air port arrangement of claim 10, wherein the front wall has the greater number of secondary air ports.

18. The air port arrangement of claim 10, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is the same wall as the wall having the greater number of secondary air ports.

19. The air port arrangement of claim 18, wherein the rear wall has the greater number of secondary air ports.

20. The air port arrangement of claim 18, wherein the front wall has the greater number of secondary air ports.

21. The air port arrangement of claim 10, wherein the elevation of liquor air ports is located approximately two feet above the black liquor guns, a first tertiary air level is located approximately six feet above the black liquor guns, a second tertiary air level is located approximately ten feet above the black liquor guns, and a third tertiary air level is located approximately fourteen feet above the black liquor guns.

22. The air port arrangement of claim 10, wherein the elevation of the liquor air ports is located a vertical distance in the range of about zero to four feet above the elevation the black liquor guns, the first tertiary level is located a vertical distance in the range of about four feet to twelve feet above the elevation of liquor air ports, and the second and any additional tertiary air levels are located and spaced from an adjacent tertiary air level at regular spaced vertical intervals in the range of about four feet to eight feet.

23. The air port arrangement of claim 10, wherein the secondary air ports further comprise a combination of larger and smaller secondary air ports which alternate across a width of the recovery boiler and wherein the larger secondary air ports on one wall are directly opposite the smaller secondary air ports on the opposing wall thereby yielding a partially interlaced secondary air arrangement.

24. The air port arrangement of claim 15, wherein the rear wall has the greater number of secondary air ports.

25. The air port arrangement of claim 15, wherein the front wall has the greater number of secondary air ports.

26. In an industrial boiler having a furnace with a front wall, a rear wall opposing the front wall, and two side walls adjoining the front and rear opposing walls, a plurality of fuel injection devices for providing fuel into the furnace, the fuel injection devices being located in the walls of the furnace and at a common elevation with respect to a floor of the furnace, and a combustion air system for providing a supply of air to the furnace, an air port arrangement associated with the combustion air system, the air port arrangement comprising:

a plurality of primary air ports in walls of the furnace which form a primary air level;

a plurality of secondary air ports only in the front and rear walls of the furnace which form one secondary air level at an elevation above the primary air level and below the common elevation of the plurality of fuel injection devices, the number of secondary air ports on one wall being one greater than the number of secondary air ports on the opposing wall, the secondary air ports on one wall being laterally offset from the secondary air ports on the opposing wall;

an elevation of fuel air ports only in the front and rear walls of the furnace; and a plurality of tertiary air ports only in the front and rear walls of the furnace which form at least two or more tertiary air levels above the elevation of fuel air ports, wherein the tertiary air ports in all of the at least two or more tertiary air levels and the fuel air ports are substantially vertically aligned with one another, and wherein at least a portion of each of the at least two or more tertiary air levels in only one of the front wall, or the back wall, of the furnace are substantially vertically aligned with a black liquor gun.

27. The air port arrangement of claim 26, wherein the elevation of the fuel air ports is located approximately two feet above the elevation of the fuel injection devices.

28. The air port arrangement of claim 26, comprising two tertiary air levels located above the elevation of fuel air ports, a first tertiary air level located approximately ten feet above the elevation of the fuel injection devices, and a second tertiary air level located approximately fourteen feet above the elevation of the fuel injection devices.

29. The air port arrangement of claim 26, comprising three levels of tertiary air located above the elevation of fuel air ports and wherein each tertiary air port is vertically aligned with a tertiary air port in an adjacent tertiary air level and with the fuel air ports in the elevation of the fuel air ports.

30. The air port arrangement of claim 29, wherein a first tertiary air level is located approximately six feet above the elevation of the fuel injection devices, a second tertiary air level is located approximately ten feet above the elevation of the fuel injection devices, and a third tertiary air level is located approximately fourteen feet above the elevation of the fuel injection devices.

31. The air port arrangement of claim 26, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is opposite the wall having the greater number of secondary air ports.

32. The air port arrangement of claim 26, wherein the rear wall has the greater number of secondary air ports.

33. The air port arrangement of claim 26, wherein the front wall has the greater number of secondary air ports.

34. The air port arrangement of claim 26, wherein the number of tertiary air ports at a given elevation on one wall is one greater than the number of tertiary air ports at the same elevation on the opposing wall, the tertiary air ports on opposing walls being laterally offset with respect to each other, and wherein the wall having the greater number of tertiary air ports is the same wall as the wall having the greater number of secondary air ports.

35. The air port arrangement of claim 34, wherein the rear wall has the greater number of secondary air ports.

36. The air port arrangement of claim 34, wherein the front wall has the greater number of secondary air ports.

37. The air port arrangement of claim 26, wherein the elevation of the liquor air ports is located a vertical distance in the range of about zero to four feet above the elevation the fuel injection devices, the first tertiary level is located a vertical distance in the range of about four feet to twelve feet above the elevation of fuel air ports, and the second and any additional tertiary air levels are located and spaced from an adjacent tertiary air level at regular spaced vertical intervals in the range of about four feet to eight feet.

38. The air port arrangement of claim 31, wherein the rear wall has the greater number of secondary air ports.

39. The air port arrangement of claim 31, wherein the front wall has the greater number of secondary air ports.

* * * * *